US005373128A

United States Patent [19]

Rosakranse et al.

[11] Patent Number: 5,373,128

[45] Date of Patent: Dec. 13, 1994

[54] WHEEL SENSING TREADLE MATRIX SWITCH ASSEMBLY FOR ROADWAYS

[75] Inventors: Robert A. Rosakranse, Accord; John G. Emerick, Saugerties, both of N.Y.

[73] Assignee: The Revenue Markets, Inc., Accord, N.Y.

[21] Appl. No.: 99,848

[22] Filed: Jul. 29, 1993

[51] Int. Cl.[5] ..... H01H 3/02

[52] U.S. Cl. ..... 200/86 A

[58] Field of Search ..... 200/85 R, 85 A, 86 R, 200/86 A; 340/666, 933; 33/203.11

[56] References Cited

U.S. PATENT DOCUMENTS

| | | | |
|---|---|---|---|
| 2,213,409 | 9/1940 | Quilliam | 340/923 |
| 3,351,724 | 11/1967 | Goble | 200/86 R |
| 3,412,224 | 11/1968 | Koenig | 200/86 R |
| 3,485,977 | 12/1969 | Goble | 200/86 R |
| 3,593,263 | 7/1971 | Olsen | 340/935 |
| 3,748,443 | 7/1973 | Kroll | 377/9 |
| 3,818,162 | 6/1974 | Monroe | 200/86 R |
| 3,821,500 | 6/1974 | Newman | 200/86 R |
| 3,835,449 | 9/1974 | Viracola | 340/933 |
| 3,944,763 | 3/1976 | Beierwaltes | 200/52 R |
| 4,013,851 | 3/1977 | Abbondante | 200/86 R |
| 4,066,851 | 1/1978 | White et al. | 200/86 R X |
| 4,383,239 | 5/1983 | Robert | 340/933 |
| 4,401,896 | 8/1983 | Fowler et al. | 307/118 |
| 4,455,465 | 6/1984 | Habeger | 200/86 R |
| 4,471,177 | 9/1984 | Doughty | 200/5 A |
| 4,525,606 | 6/1985 | Sado | 200/86 R X |
| 4,677,417 | 6/1987 | Amagishi | 200/86 R X |
| 4,787,243 | 11/1988 | Gaucher | 200/86 A X |
| 4,839,480 | 6/1989 | Bickley | 200/86 A |
| 4,857,683 | 8/1989 | Maser | 200/5 A |
| 4,888,581 | 12/1989 | Guscott | 340/666 |
| 4,947,353 | 8/1990 | Quinlan, Jr. | 364/562 |
| 4,963,705 | 10/1990 | Broderick et al. | 200/86 R |
| 5,056,884 | 10/1991 | Quinlan, Jr. | 385/13 |
| 5,115,109 | 5/1992 | Fisher | 200/86 A |
| 5,239,148 | 8/1993 | Reed | 200/86 A |

OTHER PUBLICATIONS

Treadle Selection Guide, The Revenue Markets, Inc.; Accord, New York (Promotional Brochure); (no date).

*Primary Examiner*—J. R. Scott

*Attorney, Agent, or Firm*—Darby & Darby

[57] ABSTRACT

A wheel sensing treadle of high sensitivity includes a thin membrane strip having a top non-conductive membrane and a bottom non-conductive membrane, the membranes being generally parallel, spaced apart, and of extended length. A large number of switches are closely positioned along the length of the membranes. Each switch includes two thin conductive contacts formed respectively on each membrane by printing with conductive ink. A similarly-printed electrical lead connects respectively to each the switch contacts. The membrane strip is sandwiched between a rigid base and a resilient cover to form a treadle of extended length. The switch contact leads are connected in an X Y matrix, each switch having one contact connected to an X line and the other contact of the switch connected to a Y line of the matrix whereby each switch in the treadle has a unique X, Y address and can be rapidly an repetitively scanned by a computer.

18 Claims, 3 Drawing Sheets

WHEEL SENSING TREADLE MATRIX SWITCH ASSEMBLY FOR ROADWAYS

BACKGROUND OF THE INVENTION

Treadles placed in or on a road surface have long been employed to monitor traffic in data systems used to provide statistical data upon which highway revisions and designs of future highways are based. In such surveys, the type and size of the vehicle passing a particular location is important. It is important to know whether automobiles or trucks are passing the traffic monitor, and if a truck, it is important that an indication of the number of axles and wheels should be obtained.

Another application of wheel sensing treadles is at toll booths where fees are collected for bridges, tunnels, toll-highways, parking lots, and the like. In such facilities, the toll which is to be collected generally is dependent upon the type of vehicle, and in the case of vehicles that are not automobiles, the toll depends upon the number of wheels and axles of the vehicle. It is important in a vehicle classification system that a treadle measuring system be able to distinguish more than the total number of vehicle axles passing a given location, that is, a revenue collection system should permit identification of vehicle type. In the case of large vehicles, for example, trucks and buses, it is important to know the number of axles and the number of wheels on each axle. It is important that single tire axles each having two wheels be distinguishable from dual tire axles each having four wheels. The tire width is also important in determining what type of vehicle has moved over the treadle.

Many treadle constructions and associated logical systems have been developed. For example, U.S. Pat. No. 3,748,443 to Kroll, et al. and U.S. Pat. No. 3,835,449 to Viracola disclose logical and physical constructions for detecting total tire axle count at a given roadway location, and for providing a breakdown that determines a dual tire axle count and a single tire axle count.

A wheel sensing treadle is generally an elongated rectangular device that in some uses lies entirely across the traffic lane of a highway, and in other applications extends across half or, generally speaking, only a portion of a highway lane. The top surface of the wheel sensing treadle is substantially flush with the roadway surface, and as a vehicle wheel rolls over the treadle, the top treadle surface is locally compressed.

This action of a wheel crossing the treadle initiates electrical signals, generally, through the closing of a switch or switches, although other techniques such as blockage of light in optical fibers has also been used to indicate that a wheel has rolled over the treadle. As described in the prior art, it is possible, by the arrangement of sensors in the treadle, to determine the travel direction of the vehicle moving across the treadle and the number of wheel axles that pass over the treadle. Theoretically, there is an ability to distinguish between a single tire axle with one tire at each axle end, and a dual tire axle with two tires at each axle end.

However, from a practical point of view, it must be noted that heretofore no actual systems having these capabilities are in use. For various reasons, known in the art, it has not been possible to produce a reliable construction that gives the widths of the individual tires and distinguishes single tire axles from dual tire axles. A significant factor in this failure to provide such a system, with reliability, is the spacing and layout of pressure switches in a treadle, as in the patents mentioned above.

In prior art treadles used in wheel sensing, a row of individual switches is generally positioned transversely to the direction of traffic flow. The switches comprise individual metal contacts embedded in a resilient material with an open gap between the contacts. When a tire rolls over the treadle, the treadle is locally compressed; the gap closes and the contacts touch to close the switch. Leads to the individual switch contacts bring signals indicating a closed switch to logical circuits that process the data into a required format.

However, the results from prior art treadles have not been accurate because an insufficiency in the number of switches arranged along the length of the treadle makes for difficult interpretation of the data, and an inability to reliably distinguish different tire combinations and tire widths. Existing treadles provide only a crude measurement of tire width. They cannot distinguish a wide single tire from a narrow dual tire.

The constructions of the prior art switches, wherein upper and lower switch contacts are individual elements, limit the number of switches which can be practically manufactured into a treadle of required length. Further, the difficulty of bringing electrical leads out of the treadle, which is generally long and of low height or thickness, provides a lead density problem that grows as the number of switches increases.

Thus, the vehicle wheel sensing treadles now in actual use have a limited quantity of switches and do no more than count total axles. Measurements of tire widths, and dual tire axles and their tire widths and spacings, have not been accomplished in a practical manner that is suitable for everyday usage in systems requiring high reliability, and quick and easy repair when failures do occur. Existing designs are not reparable.

What is needed is a highly reliable treadle for wheel sensing that can distinguish tire widths, dual and single tire axles, tire spacings and total axle count in an effective and economical manner.

SUMMARY OF THE INVENTION

It is an object of the invention to provide an improved wheel sensing treadle able to provide total axle count in a traffic measurement system and to detect and distinguish dual tire and single tire axles.

It is a further object of the invention to provide an improved wheel sensing treadle that is highly reliable and easily serviced.

Another object of the invention is to provide an improved wheel sensing treadle that can be used as an interchangeable replacement for presently used treadles of less sensitivity, without modification to existing treadle holders.

Yet another object of the invention is to provide an improved wheel sensing treadle that provides high sensitivity.

A wheel sensing treadle in accordance with the invention includes a thin membrane strip having a top non-conductive membrane and a bottom non-conductive membrane, the membranes being generally parallel, spaced apart, and of extended length.

A plurality of switches are closely positioned along the length of the membranes and each switch includes two conductive contacts formed respectively on each membrane by printing, for example, with conductive ink. A similarly printed electrical contact lead connects respectively to each of said switch contacts. The membrane strip is sandwiched between a rigid base and a resilient cover.

The switch contact leads are connected to form an X Y matrix, each switch having one contact connected to an X line of the matrix and the other contact of the switch connected to a Y line of the matrix. Thus, each switch in the treadle has a unique X, Y address and can be rapidly and repetitively scanned by a computer.

In a conventional treadle length, use of membrane switches allows for an increased number of switches and correspondingly increased treadle sensitivity. Matrix "wiring" of the switches greatly reduces the quantity of external connecting leads, and the membrane switches have a long operating life.

Further objects and advantages of the invention will be apparent from the following detailed description and drawings. The invention, accordingly, comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
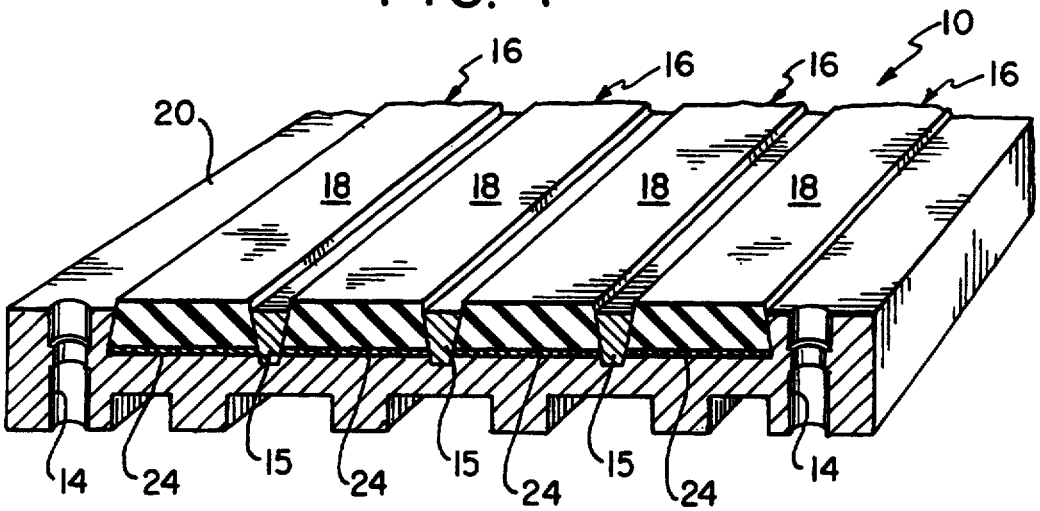
FIG. 1 is a top perspective view, with a transverse section, of a four sensor strip treadle in accordance with the invention.
Figure 2:
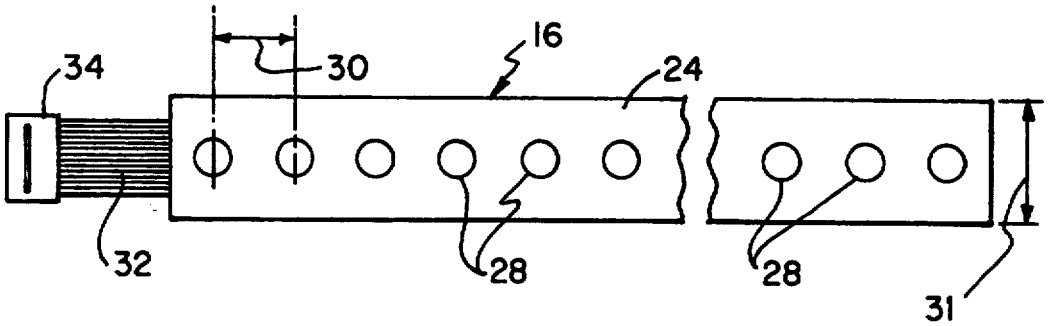
FIG. 2 is a functional representation of a membrane strip in the treadle of FIG. 1.
Figure 3:
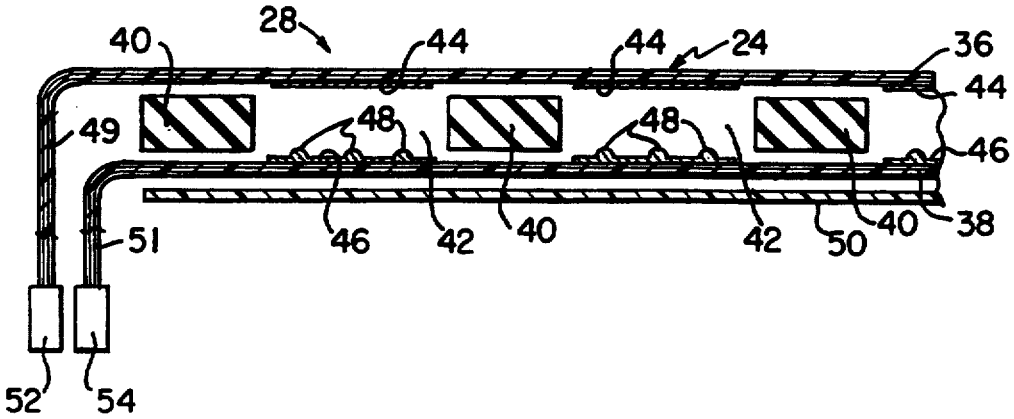
FIG. 3 is a membrane switch in exploded cross section, as in the membrane strip of FIG. 2.

With reference to FIGS. 1-3, the wheel sensing treadle 10 includes a base 12 of rigid material, for example, aluminum, steel, plastic, etc. Holes 14 through the base 12 are provided for fasteners used in attaching the base 12 to a treadle holder (not shown) that has been incorporated into or onto the surface of a highway lane, for example, adjacent to a toll booth on a toll highway or bridge.

In FIG. 1, four sensor strips 16 of trapezoidal shape are retained by intermediate metal trapezoidal hold down bars 15 that are attached to the base 12 by means of screw fasteners (not shown) The sensor strips 16 and bars 15 extend in the longitudinal direction of the treadle. In order to extend across the width of a highway lane of conventional dimensions, each sensor strip has a length in the order of nine to ten feet. However, from a practical point of view, it is difficult to produce such an extended sensor strip 16 and two sensor strips 16 of lesser length, set end to end, may be used in many applications where an entire lane is spanned.

For reasons of redundancy, and for detecting the direction of travel of an axle over the treadle, four sensor strips 16, in parallel, are illustrated in FIG. 1. However, it is known in the art that wheel sensing treadles 10 can have one sensor strip 16, two strips, the illustrated four strips, and others quantities, all within the scope of the invention.

The upper surface 18 of the sensor strip 16 extends above the upper surface 20 of the treadle base 12. Each of the sensor strips 16 includes a membrane strip 24 that extends the length of the sensor strip 16 and is covered by a resilient rubber bar 26, which provides the interface with the tires.

With reference to FIG. 2, a membrane strip 24 includes a large quantity of closely spaced membrane switches 28 that are uniformly spaced at a pitch distance 30 and aligned along the length of the strip 24. A membrane strip 24 may be, for example, in the order of 56 inches long and include 56 circular membrane switches 28 having a diameter of approximately ½ inch and a center to center spacing 30 of 1 inch. With such dimensions, the membrane strip 24 can include 56 switches and two such membrane strips 24, set end to end, can span a typical highway lane, that is approximately nine linear feet.

Electrical leads 32 extend from the switches 28 such that the state, open or closed, of the switches 28 can be detected. The leads 32 extend to a conventional connector 34. From the connector 34, signals indicative of the operating state of the switches 28 can be carried to a computer (not shown)for processing into the desired data, for example, the number of axles moving over the treadle, tire characteristics, whether narrow or wide, and the type of axle, whether a single tire axle or dual tire axle. Measurement of the gap between adjacent dual tires can also be accomplished.

Although, switches of approximately ½ inch diameter, on 1 inch centers have been described, it should be understood that different center spacings, for example, 2 inches, may be used, and the diameters of the switches may be larger or smaller. Also, the switches may be staggered to effectively reduce the lengthwise spacing of the switches. The greater is the quantity of switches 28 that can be fit into a given length of the sensor strip 16, the greater is the sensitivity of the device. Reliability is improved, as there is redundancy for switches that may become permanently short circuited in use. Also, as the closeness and quantity of the switches increases, it is easier to distinguish dual tire axles and the distance between the adjacent tires on such dual tire axles.

However, as the number of switches increases, so does the number of electrical leads that are required to carry signals indicating the state of the switches 28, whether open or closed. In a sensor strip 16, for example, having 56 switches, there can be as many as 112 leads when it is considered that two leads are required for the two contacts of each switch. Using a common lead for each switch reduces the number of leads to 57. However, such a quantity of leads is physically difficult to manage when it is considered that eight sensor strips 16, in end-to-end pairs, may be required for a four strip treadle 10, as illustrated in FIG. 1. In such a situation there are 448 switches.

The problem of routing such a large number of electrical leads is aggravated because the sensor strip 16 preferably should be dimensionally compatible with older prior art treadle sensor strips that incorporate a much smaller number of switches. Then, old equipment can, in time, be upgraded with new treadles. Upgrading can be completed without need to perform the major task of changing the treadle holder, which is cast into concrete with the related conduit and drainage.

In accordance with the present invention, the goals of high sensitivity and high reliability are achieved, and potential difficulties in handling the large number of electrical leads associated with a large number of electrical switches are avoided by using membrane technology for the switches and their connections.

A membrane switch 28 (FIG. 3) includes a top membrane 36 and a bottom membrane 38, which is separated from the top membrane by an intermediate spacer 40. The top and bottom membranes are made of a non-conducting material, for example, mylar, polyester, etc., which has a high fatigue strength. The spacer 40, which is generally thicker than either of the top and bottom membranes 36, 38, is resilient, for example, vinyl, polyester, etc. and has an opening 42 so that the top and bottom membranes 36, 38 oppose each other through the opening 42.

An electrically conductive switch contact 44 is attached to the top membrane 36, and an electrically conductive switch contact 46 is connected to the bottom membrane 38. These contacts can be extremely thin, for example, as would be produced by using a film or layer of conductive silver ink that is commercially available. The contact may be applied to the membrane by a printing process, may be electro-deposited, rolled on, or be applied in a multi-step photographic process. Such technologies are well known in the art and are accordingly not described in detail in this application. The resultant contact and switch are thin and resilient, and can be used for many cycles of the switch before failure of the contacts or membranes. An operating life exceeding three million cycles is anticipated.

The switches 28 are oriented in the treadle membrane strip 24 such that when a vehicle rolls over the treadle 10, the wheels compress the spacer 40 and bring the upper switch contact 44 into electrical connection with the bottom switch contact 46. Thus, the switch is closed. After the wheel has moved beyond the switch 28, the resiliency of the spacer 40 urges the contacts into the separated, open state, as illustrated. Switch closings are local, that is, closings occur only beneath a wheel and immediately adjacent to the wheel, as is known to those skilled in the art.

To reduce the impact of the contacts 44, 46 when the switch 28 is closing, dots 48 of dielectric material are formed on the surface of the bottom switch contact 46. These dielectric dots 48 are compressible such that there is cushioning before a complete switch closure is effected.

A membrane adhesive layer 50 attaches to the underside of the bottom membrane 38 and is used in joining the bottom membrane to a very thin reinforcing sheet (not shown) that is part of the membrane strip 24.

In a membrane strip 24 as in FIG. 2, fifty-six switches 28 of the construction in FIG. 3 are provided. In such a construction, the opening 42 has a diameter in excess of ½ inch. The entire membrane strip 24 is thin. For example, the top membrane 36 may be in the order of 0.005 inches thick, the spacer 40 in the order of 0.009 inches thick, the bottom membrane 38 in the order of 0.005 inches thick, and the membrane adhesive layer 50 may be 0.002 inches thick (0.21 inches total).

An electrical lead extends from each electrical contact 44, 46 of a switch 28. These leads are formed on the respective surfaces of the top and bottom membranes 36, 38 concurrently, and of the same material, with formation of the switch contacts 44, 46. Thus, for example, the entire array of switch contacts 44, 46 and its required wiring 49, 51 is printed on the membranes in a concurrent operation. This printing adds no substantial thickness to the assembled sandwich structure of the membrane strip 24. The electrical leads are printed along the length of the membranes 36, 38 and are terminated in respective connectors 52, 54.

Figure 4:
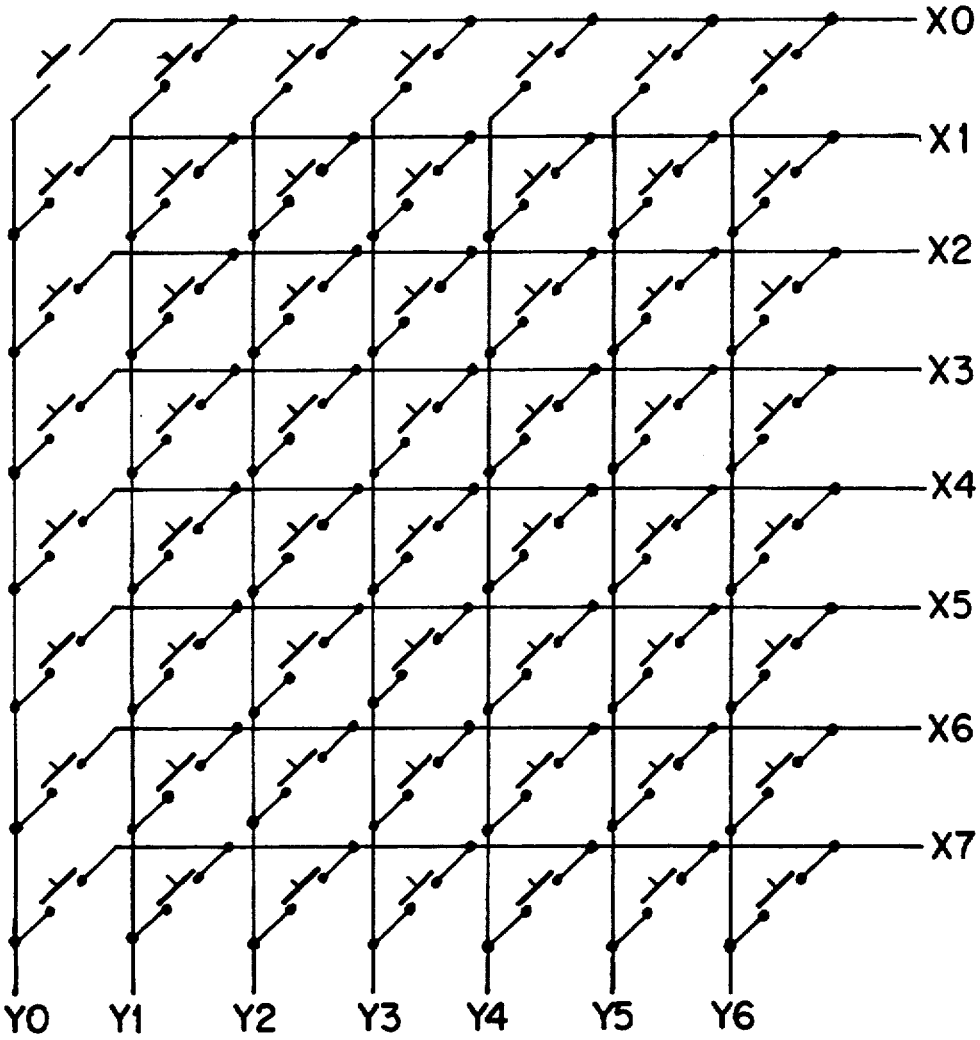
FIG. 4 is a schematic of matrix connections for switches in a membrane strip as in FIG. 2.

FIG. 4 illustrates a matrix arrangement for 37 wiring" switches 28 on a membrane strip 24 having fifty-six switches. Common X leads cross common Y leads without interconnection at the intersections to form an X, Y grid. Each switch 28 has one contact connected to an X lead and the other contact connected to a Y lead. For a membrane strip 24 as in FIG. 2, each X lead connects to seven switches and each Y lead connects to eight switches. Thus, only fifteen lead connections, X0–X7 and Y0–Y6, are needed for monitoring operation of fifty-six switches. It will be apparent that the actual electrical leads 49, 51 that are printed on the top and bottom membranes 36, 38 need not physically be in a neat checkerboard arrangement as illustrated in FIG. 4, but electrically constitute such a construction.

For other switch spacings and quantities (not shown), other matrices, such as, for example, 4×8 or 2×16, may be used.

Figure 5:
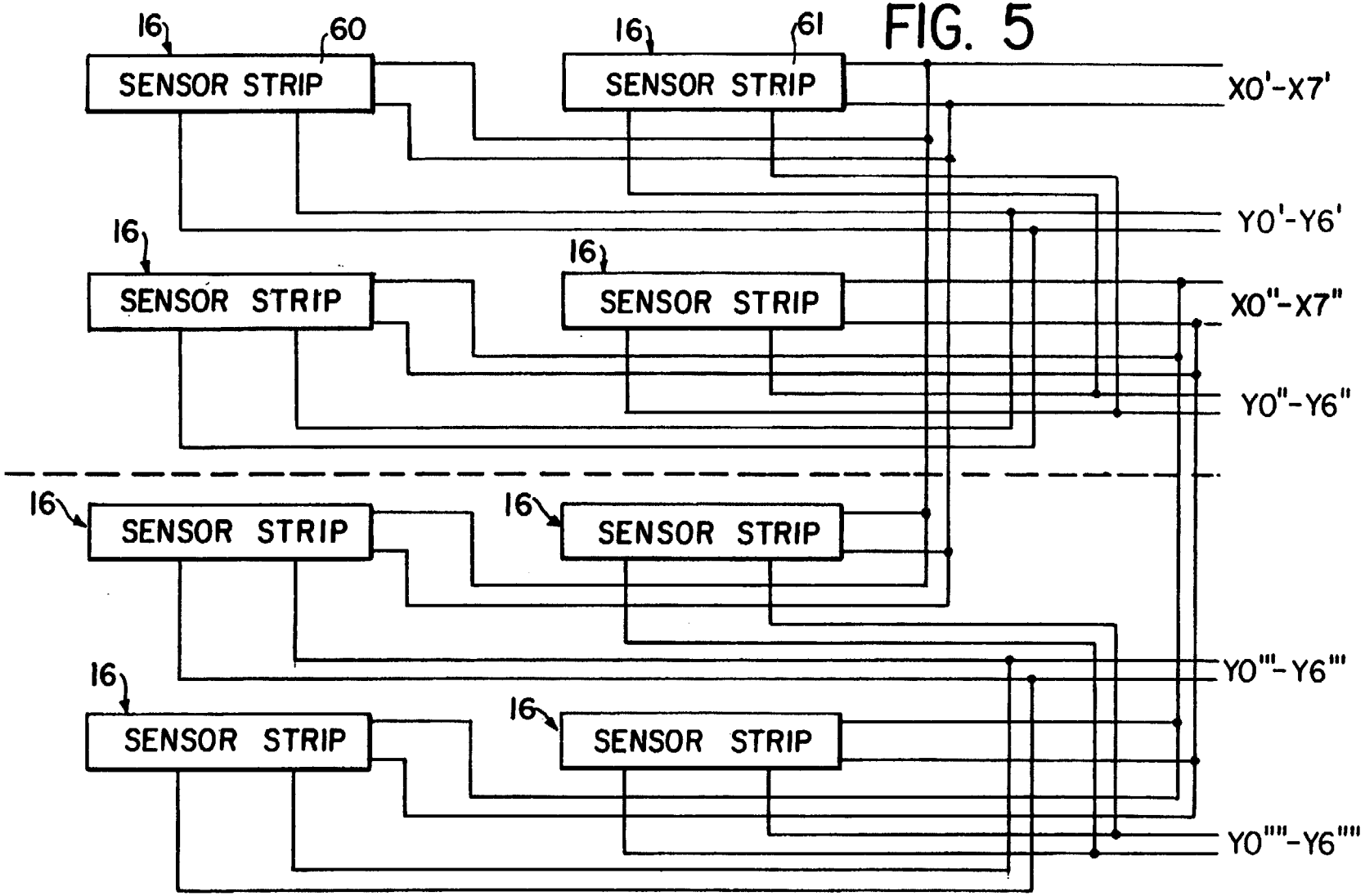
FIG. 5 is a schematic of electrical connections for a eight sensor strip treadle.

FIG. 5 indicates a circuit arrangement for a four strip treadle 10 as in FIG. 1, wherein eight fifty-six switch sensor strips 16 are used. An approximate treadle length of nine to ten feet is achieved by placing two sensor strips 16 end to end. Pairs of sensor strips are connected in a semi-parallel arrangement. For example, a pair of sensor strips 60, 61 are connected in parallel with regard to the X leads X0′–X7′ of their respective matrixes. However, the same pair of sensor strips 60, 61 are not connected in parallel to each other with regard to the Y leads of the same matrixes.

For fifty-six switches in a single matrix (FIG. 4) there are, as stated, only fifteen leads. Where there are eight sensor strips 16 (FIG. 5) in combination, each of the 448 switches maintains a unique X, Y address, and there are only forty-four contact leads that must be brought out externally of the sensor strips 16 for further data processing of switch signals. Such a lead density can easily be configured on the upper and lower membranes 36, 38 together with the extended row of sensor switches 28 when the width 31 (FIG. 2) of a membrane strip 24 is in the order of 1½ inches.

Thus, by using membrane technology, wheel sensing treadles 10 of high sensitivity, that is, having many independent switches located close together, are accommodated (including their electrical connections) within physical dimensions that correspond to treadle switches now in use. Upgrading or replacement of existing equipment is easily accomplished, especially when an existing treadle becomes inoperative in use.

To remove and replace a membrane strip 24, it is only necessary to loosen or remove the fasteners (not shown) on the adjacent hold-down bars 15 and slide out the old membrane strip 24 and insert a new one. There is no bonding between the treadle bar 26 and the associated membrane strip 24. The strip 24 and bars 26 are restrained by the wedging force exerted when the hold down bar 15 is tightened into place.

Also, because each switch has a unique X Y address, every switch 28 in a treadle assembly can be scanned independently by computer on a rapid, repetitive basis, for example, every millisecond. In this way, any switch that may develop a permanent short circuit can be identified, and the data from that switch can be filtered out of the results. Also, by rapid scanning, steady-state signals can be determined after the bouncing phenomenon that frequently occurs when a wheel passes over a treadle.

Figure 6:
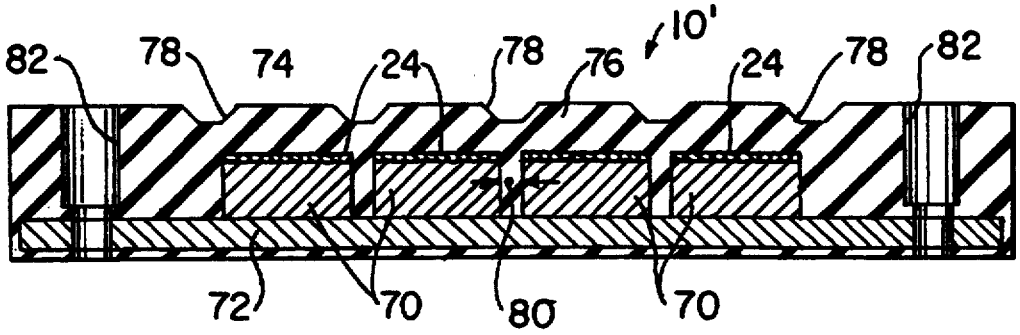
FIG. 6 is a transverse section of an alternative embodiment of a treadle in accordance with the invention.

In an alternative treadle 10' in accordance with the invention (FIG. 6), four membrane strips 24, as described above, are positioned on spacers 70 that in turn rest upon a base 72.

The base and spacers are rigid material, for example, steel, aluminum, etc. The entire structure of membrane strips 24, spacers 70 and base 72 is enclosed in a resilient rubber covering 74 or shell, which extends below the base 72 and provides a water-impervious enclosure for the sensing elements. The upper surface 76 of the treadle 10' includes notches 78 that are in alignment with spaces 80 between the membrane strips 24. These notches concentrate the forces, generated by a wheel passing over the treadle 10, onto the sensor strips 24.

The treadle 10' is attached to a treadle holder (not shown) on the roadway surface by means of fasteners that pass through the openings 82.

Processing of the data from the treadle switches is not considered to be part of the present invention and is not discussed fully herein. With the constructions described above, it is possible to determine the number of axles passing over the treadle, the direction of vehicle motion, tire width and the number of tires on an axle. Determining the direction of vehicle motion requires that a wheel pass over more than one treadle strip. Three or more strips can be used to distinguish when a person walks on the treadles. Also, because of the close switch spacings, it is possible to determine the space between adjacent tires in a dual tire axle arrangement on a vehicle. Accordingly, the objects of the invention have been attained.

Also, because all switches can be frequently and repetitively sensed by computer for their respective open and closed states, it is possible to determine, in view of the pattern of switch closings that is produced, whether a person is stepping on the treadle.

It will thus be seen that the objects set forth above, and those made apparent from the preceding description, are efficiently attained and since certain changes may be made in the above constructions without departing from the spirit or the scope of the invention, it is intended that all matter contained in the above description or shown in the accompanying drawings shall be interpreted as illustrative and not in a limiting sense.

What is claimed is

1. A wheel sensing treadle matrix switch assembly for roadway use in obtaining traffic data, comprising:

a membrane strip having a top non-conductive membrane and a bottom non-conductive membrane, said membranes being generally parallel, spaced apart, and of extended length;

a plurality of switches positioned along the length of said membranes, each of said switches including two conductive contacts, said contacts in a first switch state being apart and electrically open and in a second switch state being together and electrically closed, one of said contacts being formed respectively on each said membrane, said contacts being generally parallel and opposed to each other in said first state;

a plurality of electrical contact leads connected respectively to each of said switch contacts and formed on the surface of the associated membrane;

a rigid base connected to said membrane strip for holding said switches in a fixed position;

a resilient cover, said membrane switch being positioned between said cover and said base, compression of said treadle by passage of a wheel axle thereover causing said switches to close locally in a lengthwise pattern corresponding to size and distribution of wheels on said axle.

2. A wheel sensing treadle matrix switch assembly as in claim 1, wherein said switches are evenly spaced along the length of said membrane strip.

3. A wheel sensing treadle matrix switch assembly as in claim 2, further comprising a non-conductive, compressible spacer between said contact on said top membrane and said contact on said bottom membrane.

4. A wheel sensing treadle matrix switch assembly as in claim 3, further comprising compressible, non-conductive dots connected to one of said switch contacts and extending towards the other of said switch contacts, said dots being compressed to allow closure of said switch when said treadle is compressed.

5. A wheel sensing treadle matrix switch assembly strip as in claim 1, wherein said switch contact leads are connected to form an X Y matrix, each switch having one contact connected to an X line of said matrix and the other contact of said switch to a Y line of said matrix, each switch in said treadle having a unique X, Y address.

6. A wheel sensing treadle matrix switch assembly as in claim 1, further comprising at least one additional similar wheel sensing treadle matrix switch assembly wherein said membrane strips of said treadles are parallel to each other and spaced apart.

7. A wheel sensing treadle matrix switch assembly as in claim 1, further comprising at least one additional similar wheel sensing treadle matrix switch assembly wherein said membrane strips are joined lengthwise in end-to-end pairs.

8. A wheel sensing treadle matrix switch assembly as in claim 1, further comprising at least one additional similar wheel sensing treadle matrix switch assembly wherein said base further connects to said at least one additional wheel sensing treadle.

9. A wheel sensing treadle matrix switch assembly as in claim 6, wherein said base further connects to said at least one additional wheel sensing treadle matrix switch assembly.

10. A wheel sensing treadle matrix switch assembly as in claim 7, wherein said base further connects to said at least one addition wheel sensing treadle matrix switch assembly.

11. A wheel sensing treadle as in claim 1, wherein said contacts include thin conductive films formed on said top and bottom membranes respectively.

12. A wheel sensing treadle as in claim 11, wherein said contacts are formed by printing on said membranes.

13. A wheel sensing treadle as in claim 1, wherein said top and bottom membranes are in the order of approximately 0.005" thick, and said spacer is in the order of 0.009" thick, the thicknesses of said switch contacts being less than the thickness of said membranes.

14. A wheel sensing treadle as in claim 1, wherein said switch contact leads extend beyond edges of said membranes, said leads terminating in an electrical connector.

15. A wheel sensing treadle as in claim 5, wherein said switch contact leads extend beyond edges of said membranes, said leads terminating in an electrical connector.

16. A wheel sensing treadle as in claim 5, wherein the number of switches is fifty-six, the number of X lines in said matrix is one of seven and eight, and the total number of X and Y lines in said matrix is fifteen.

17. A wheel sensing treadle as in claim 1, wherein the number of said switches is fifty-six, said switches having a diameter of approximately ½ inch and being spaced apart on one inch centers.

18. A wheel sensing treadle as in claim 16, wherein the number of said switches is fifty-six, said switches having a diameter of approximately ½ inch and being spaced apart on one inch centers.

* * * * *